United States Patent [19]

Klund

[11] 3,982,474

[45] Sept. 28, 1976

[54] CASE ERECTING AND FORMING MACHINE

[75] Inventor: Robert N. Klund, Stillwater, Minn.

[73] Assignee: Delkor Industries, Inc., Minneapolis, Minn.

[22] Filed: May 23, 1975

[21] Appl. No.: 580,365

[52] U.S. Cl. ..... 93/53 SD; 53/186; 93/53 AC

[51] Int. Cl.[2] ..... B31B 1/80; B65B 43/30

[58] Field of Search ..... 93/53 R, 53 AC, 53 SD; 53/186

[56] References Cited

UNITED STATES PATENTS 3,537,361 11/1970 Derderian et al. ..... 53/186 X 3,911,799 10/1975 Klund ..... 93/53 AC X

*Primary Examiner*—Travis S. McGehee

*Attorney, Agent, or Firm*—Schroeder, Siegfried, Ryan & Vidas

[57] ABSTRACT

A case opening machine for automatically opening knocked-down cases of varying size utilizing rotary devices carried on movable frames to transport the unopened case, to open the case and to eject the opened case from the machine.

8 Claims, 23 Drawing Figures

CASE ERECTING AND FORMING MACHINE

This invention relates to apparatus for setting up foldable cases and more particularly to apparatus for opening flattened foldable shipping containers into a rectangular shape.

The present invention apparatus accepts a multiplicity of sizes of unopened foldable cases which are described in the art and in the following specification as "knocked-down" cases. The cases are usually formed from a single sheet of corrugated cardboard which is cut, creased and folded into a configuration having a thickness which is twice the thickness of the cardboard, a length which is equal to the length plus the width of the assembled case and a height when laid on its edge equal to the height of the opened case plus the length of the upper and lower flaps.

A user of such foldable cases receives them in individual knocked-down form from the manufacturer and then sets each case up by opening it to a rectangular shape and then folding the bottom flaps inwardly to a closed position. In the prior art there are machines which are operable for opening knocked-down cases but those machines must be adjusted whenever it is necessary to run cases of differing sizes. In addition to being slower because of the necessity for adjusting to accommodate different case sizes, the prior art machines operate to set up cases of a particular size slower than my machine and may not operate properly if the knocked-down cases are bent or damaged.

In the present invention a variety of sizes of knocked-down cases can be set up without adjustment to the machine. The machine will also set up cases which have been damaged. The machine will accept cases of varying size in any order that they are loaded in a magazine. The knocked-down cases are then individually fed to the case opening mechanism by driven wheels which transport the case into the opening mechanism and then are used in conjunction with suction cups to exert an opening force on the sides of the knocked-down case. As the case is opened, the wheels move apart to accommodate the opened case and are again driven to transport the case out of the opening mechanism to the next work station.

Accordingly, it is an object of this invention to provide an improved machine for setting up foldable cases.

It is also an object of this invention to provide apparatus for automatically setting up knocked-down cases of varying size without manual intervention for adjustment of the machine.

It is a further object of my invention to provide apparatus for delivering erected knocked-down cases in an upright condition at a fixed height which is independent of the size of the knocked-down case.

It is a still further object of the present invention to provide knocked-down case set-up apparatus which operates at a high speed by performing several operations in parallel.

It is still another object of the present invention to eliminate the use of parts in rectilinear motion to move a knocked-down case from point to point.

It is yet another object of the present invention to provide apparatus for setting up partially crushed or damaged knocked-down cases.

It is another object of the present invention to provide a machine for erecting knocked-down cases which has substantially universal applicability irrespective of the size of the case and without adjustment.

These and other objects and advantages of the invention will more fully appear from the following description, made in connection with the accompanying drawings, wherein like reference characters refer to the same or similar parts throughout the several views, and in which.

FIGS. 19*a* –19*d* are schematics of the control circuits for the case set-up apparatus.

Figure 20:
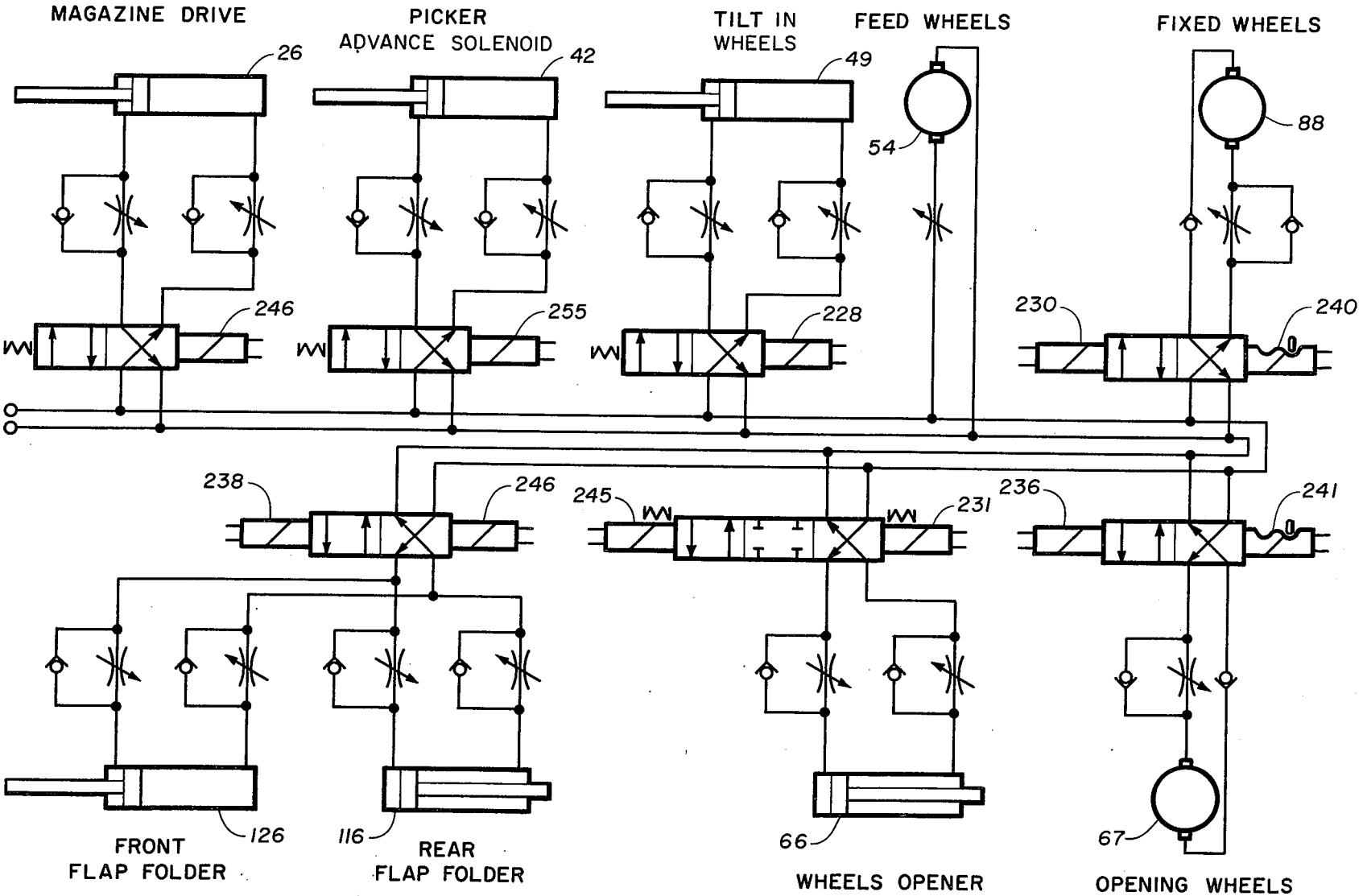

FIG. 20 is a hydraulic schematic showing the operation of the various control elements of the case set-up apparatus.

Figure 1:
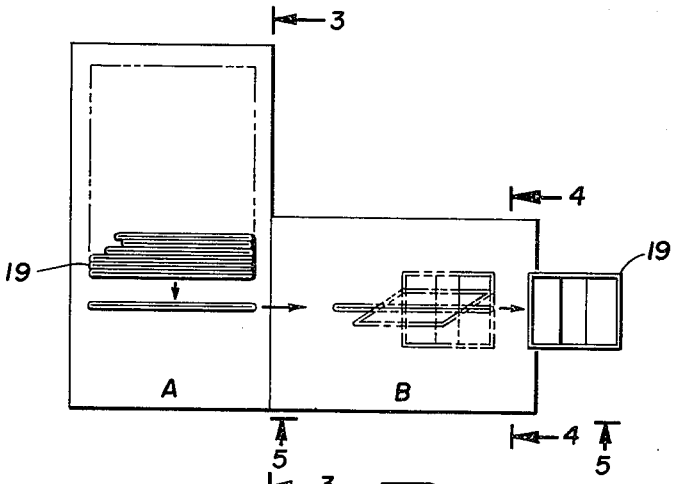
FIG. 1 is a simplified layout of the case set-up apparatus illustrating the progression of a knocked-down case through the machine.

The drawings show various views of a preferred embodiment of a case set-up apparatus utilizing the teachings of the present invention. For ease of description, the machine may be functionally divided as shown in FIG. 1 into a case feeder magazine mechanism A and a case opening and bottom end flap closing mechanism B. The detailed description of each of these mechanisms is preceded by a general description of the complete machine and followed by a description of the control circuit shown in FIGS. 19 and 20 and a description of the machine operating cycle.

GENERAL DESCRIPTION OF OPERATION

Figure 2:
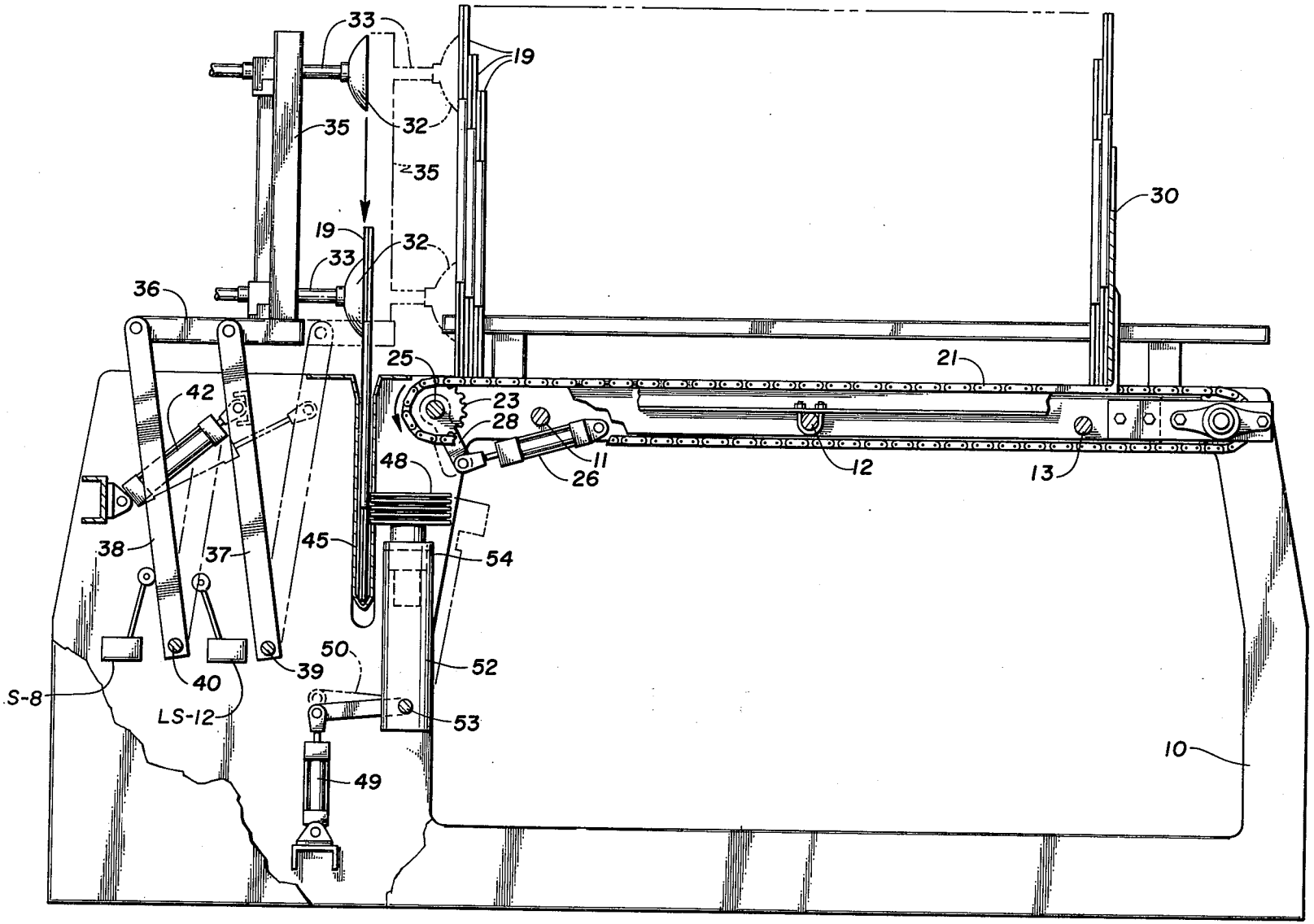
FIG. 2 is a side view of the case feeder mechanism.
Figure 3:
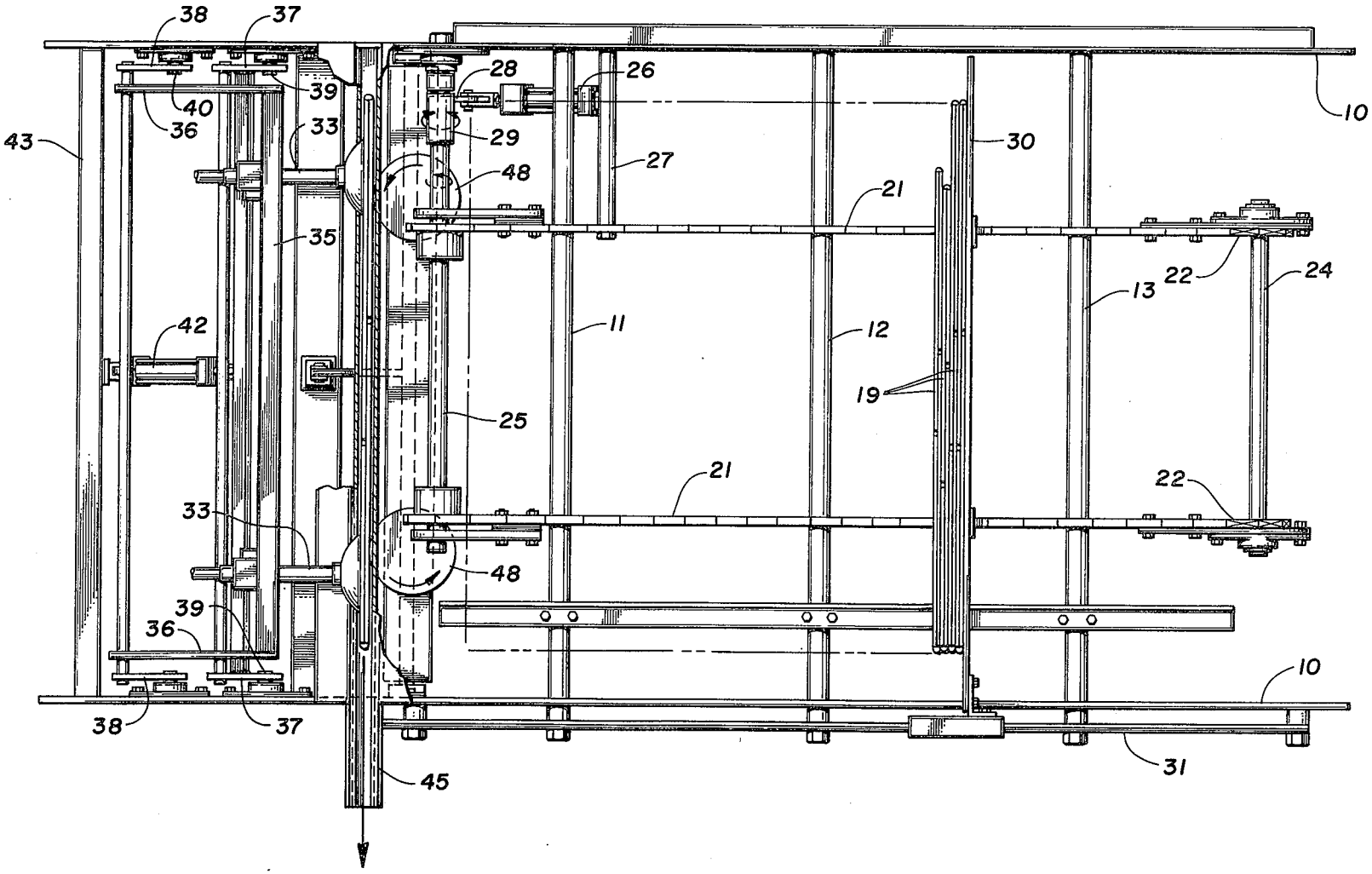
FIG. 3 is a top view of the case feeder mechanism.
Figure 5:
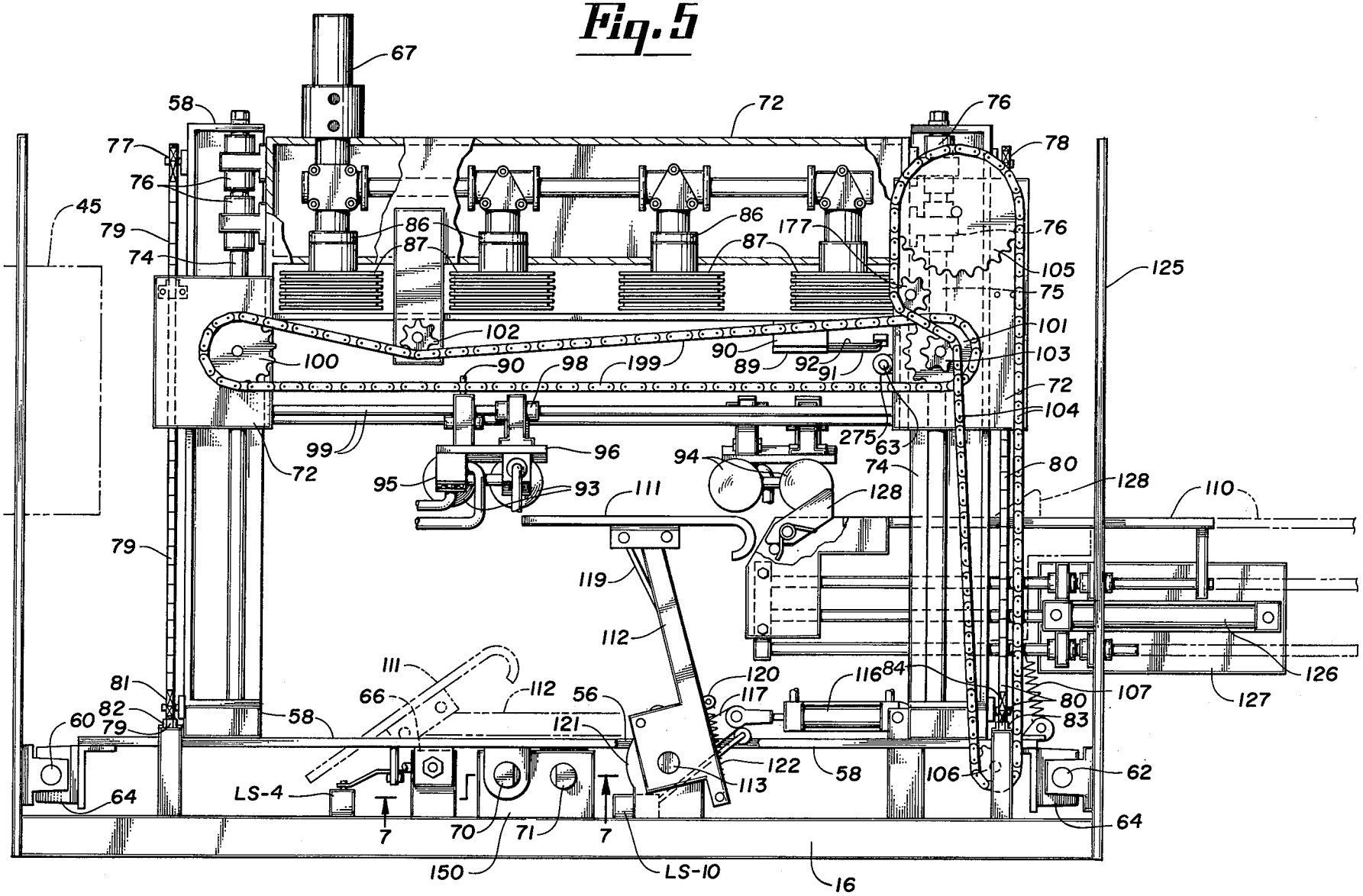
FIG. 5 is a side view of the case opening and bottom flap closing mechanism in position to receive an unopened case from the case feeder mechanism and in position for delivery to the case opening and bottom flap closing mechanism.

Each of the two functional sections of the machine is, in the preferred embodiment shown, mounted on a separate frame as can best be seen in FIGS. 2 and 5. The case feeder mechanism A shown in FIGS. 2 and 3 is mounted on framework end sections 10 which are supported and separated by support bars 11, 12, and 13. The case opening mechanism B is mounted on frame 16. Although the preferred embodiment shown utilizes separate frames for each of the functionally separate portions, the machine can, if desired, be mounted on a unitary frame.

The case feeder mechanism A, which will hereinafter be described in detail, includes magazine means for holding a number of knocked-down cases of varying sizes in a stack and delivering the cases one at a time as needed into a chute from which they may then be delivered to case opening mechanism B. The case magazine includes means for continually advancing the stack of unopened cases to position a lead case in a delivery position adjacent to the chute so that it can be engaged by a picker mechanism, removed from the magazine and positioned in the chute. Rotating drive wheels are brought into contact with the sides of the unopened case to drive the case into case opening mechanism B. Further pairs of rotating drive wheels located in the case opening mechanism on either side of the case propel it into mechanism B.

After the case is fully inserted into the case opening mechanism B, the set of rotating drive wheels on one side of the case is stopped, sets of vacuum cups grip the case on each side to urge its side walls into contact with the wheels, and the drive wheels and the vacuum cups exert a force on the case tending to open the case. At the same time, horizontally movable frames carrying the sets of drive wheels are separated to allow the case to open due to the combined action of the driven wheels and the vacuum cups. At the same time that the frames are being separated to accommodate the increasing width of the case as it is opened, vertically movable frames, which carry the drive wheels and are mounted on the horizontally movable frames, are lowered to position the bottom of the case, when it is fully opened, at a predetermined height relative to the base of the machine. This predetermined height is fixed and independent of the size of the case being opened by the machine and allows the flap closing mechanism to readily close the minor flaps of the case and assures that all cases removed from the machine exit at a fixed height, permitting them to be received in appropriate gluing or fastening apparatus for example.

CASE FEEDER MECHANISM

The feeder mechanism A, shown in side view in FIG. 2, includes a magazine for holding a stack of knock-down cases designated as 19. Because of the nature of the operation of the machine, it is not necessary that the magazine be loaded with cases having the same dimensions since the case opening machine will automatically adjust itself to accommodate a plurality of case sizes. The cases are arranged so that each case, when viewed from the front of the magazine, has one end panel portion positioned to the right. The cases are mounted on chains 21, each of which is supported at either end by sprockets 22 and 23. Sprockets 22 are mounted on the ends of shaft 25. The drive for shaft 25 and chains 21 is provided by a piston and cylinder unit 26 which is attached at one end to a support bar 27, which is in turn attached to framework end section 10. The piston rod end of unit 26 is connected to a crank arm 28 which connects to an outer sleeve 29 which has a one-way ratcheted connection to shaft 25 and a brake is also attached to keep the shaft from backing up. Each time the piston and cylinder arrangement 26 is actuated to draw the piston into the cylinder, sprocket 25 and sprocket 23 are rotated by a fixed increment to move chains 21 forward by a distance corresponding to the thickness of a single knocked-down case. The stack of cases is held upright on the flights 21 by an upright support 30 carried by the chains 21. Upright support 30 is also slidably supported by side frame 31.

The leading knocked-down case on the case magazine is engaged by one or more vacuum operated suction heads 32 which are carried by a picker mechanism. The suction heads are mounted on shafts 33 and each head is connected to a controlled vacuum supply, the control for which is illustrated in FIG. 19. Each shaft 33 is connected to a frame 35 as shown in FIGS. 2 and 3. Frame 35 is connected to horizontal member 36 which is in turn pivotally connected to a pair of links 37 and 38 which are pivotally connected at their other end to shafts 39 and 40 which are fixed to the framework end sections 10. Suction heads 32 are advanced to engage the lead knock-down case by extension of piston and cylinder unit 42 which is pivotally connected at one end to frame 10 and at the other end to link 37. Actuation of unit 42 by the control mechanism shown in FIG. 19 causes links 37 and 38 to pivot about shafts 39 and 40 to move horizontal frame 36 forward while maintaining its horizontal orientation and moves one or more of suction heads 32 into contact with the face of the leading case on the case feed magazine. Vacuum is applied to the suction heads by the control circuitry of FIG. 19 when the frame is not in the retracted position. Limit switches LS-8 and LS-12 which are shown in FIG. 2 as well as LS-1 and LS-2 which are not shown, control operation of the magazine.

During a normal operating cycle, suction heads 32 move forward, engage one case and retract, pulling a single case from the magazine. After retraction, the vacuum from the suction heads 32 is released by actuation of LS-8 to drop the case into chute 45. The side of chute 45 is provided with a pair of side slots through which rubber wheels 48 can be selectably inserted to engage the sides of a knock-down case in the chute. Wheels 48 are moved through the slots by action of piston and cylinder unit 49 connected to framework 10 at one end and at the other end to a link 50 which is rigidly connected to a tubular housing 52 which is pivotally mounted for rotation about a shaft 53. Extension and retraction of unit 49 by operation of the control in FIG. 19 causes the wheels 48 to be tilted from the initial position shown in FIG. 2 in phantom outline to an operative position in contact with a case previously dropped into chute 45. The action of the wheels drives the case along chute 45 and wheels 48 are then tilted back to the initial position to remove them from the slots until the next case is dropped in the chute. Drive motor 54, located in housing 52 in the preferred embodiment, keeps wheels 48 continuously rotating.

CASE OPENING MECHANISM

Figure 4:
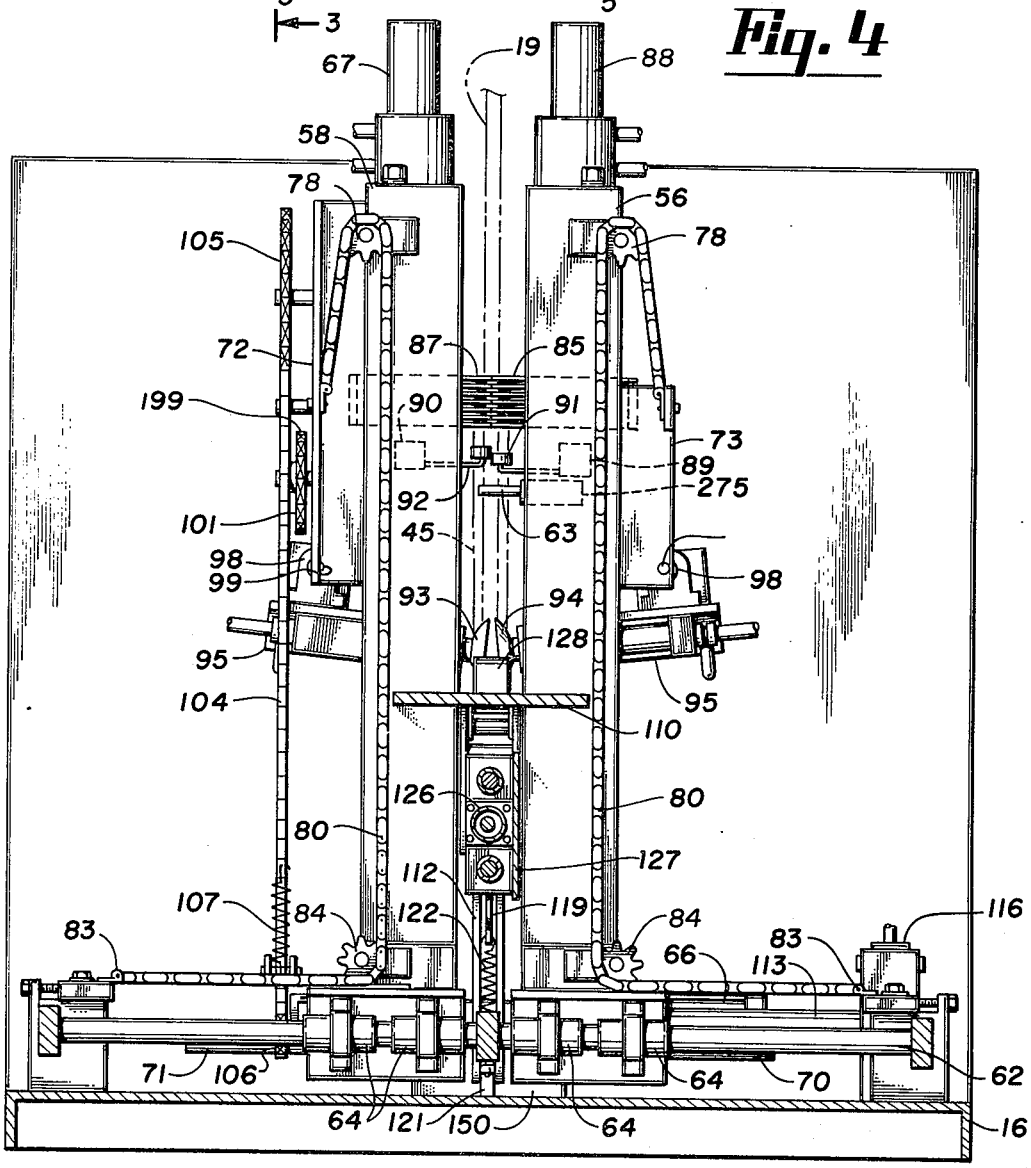
FIG. 4 is an end of the case opening and bottom flap closing mechanism in position to receive a unopened case from the case feeder mechanism.
Figure 6:
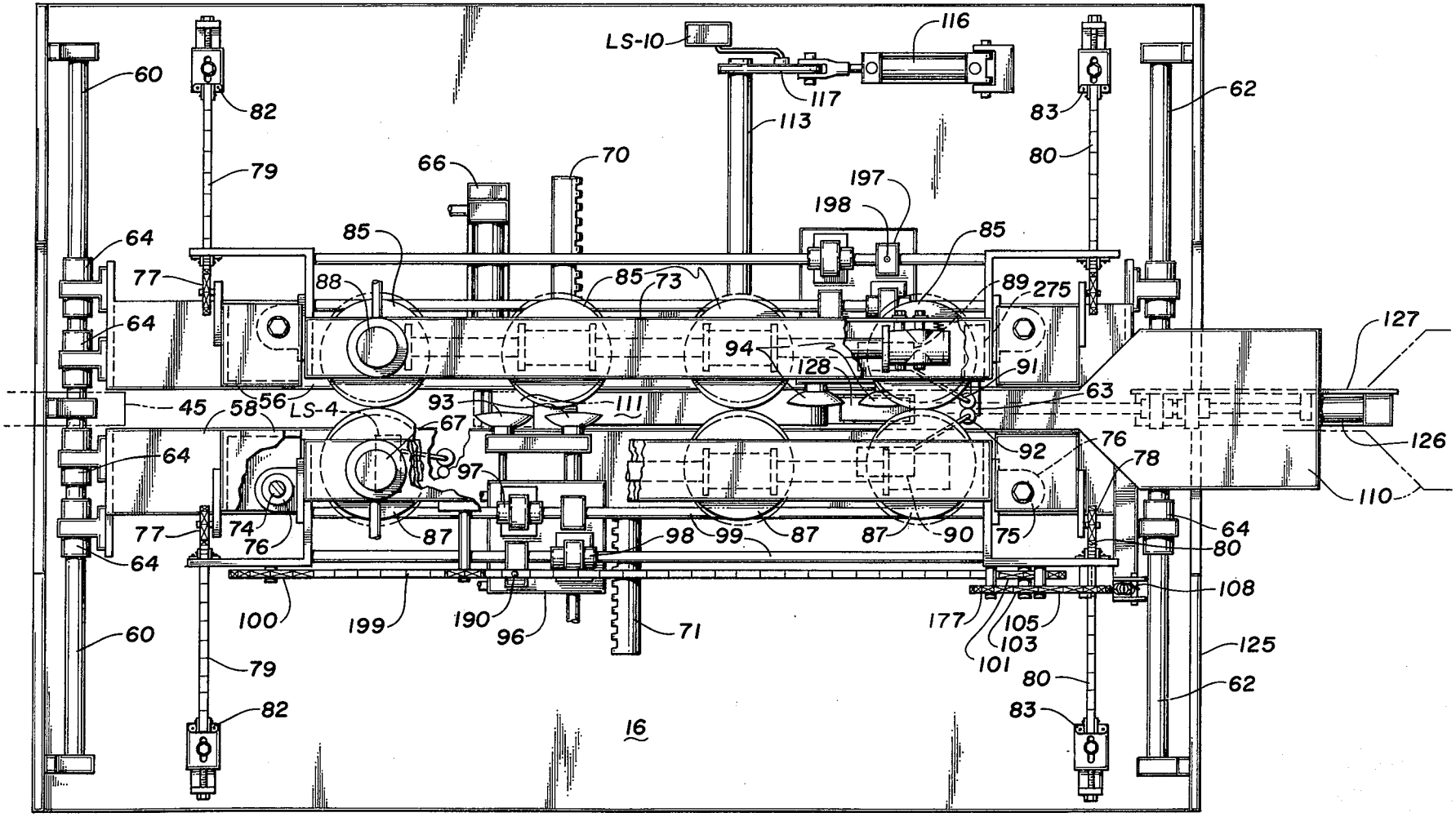
FIG. 6 is a top view of the case opening and bottom flap closing mechanism in position to receive an unopened case from the case feeder mechanism.

As shown in FIGS. 4 through 6, the opening mechanism B is positioned to receive and open a knocked-down case received from chute 45 of the feeder mechanism A when unit 49 is actuated to bring wheel 48 in contact with the case and drive it along the chute. The case is inserted along a case transfer path between two parallel vertical frames 56 and 58 which are slidably mounted in the horizontal plane on shafts 60 and 62 by means of sliding bearings 64. The frames can be moved relative to each other to provide a case opening area by means of a piston and cylinder unit and a double rack and pinion as shown in more detail in FIG. 7.

Figure 7:
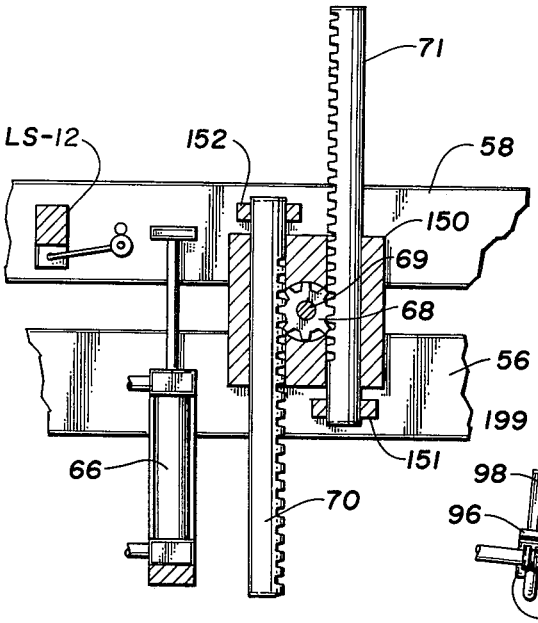
FIG. 7 is a view from the bottom plate of the opening mechanism which is used to separate the two upright frames on the case opening mechanism.

As shown in FIG. 7, piston and cylinder unit 66 is connected at one end to base 16 and at the other end to frame 58. Actuation of unit 66 by the control circuitry shown in FIG. 19, when the unopened case is fully inserted into the opening mechanism B, causes frame 58 to move outwardly along frame 16. Frame 56 is moved an equal distance in the opposite direction by the action of the double rack and pinion arrangement. Pinion gear 68 is mounted for rotation about a shaft 69 which is attached to frame 150 which is, in turn, attached to frame 16. The teeth of pinion gear 68 are engaged with the gear teeth of rack 70 which is attached to frame 58 and rack 71 which is attached to bracket 151 which is attached to frame 56. Actuator unit 66 moves frame 58 and rack 70 which causes pinion gear 68 to rotate and drive rack 71 to move frame 56.

Referring now to FIGS. 4, 5 and 6, in particular, a further frame 72 is mounted on frame 58 and a similar further frame 73 is mounted on frame 56. Frames 72 and 83 are mounted for slidable movement on shafts 74 and 75 by means of sliding bearings 76. Frames 72 and 73 are raised and lowered to a height determined by the separation of frames 56 and 58 by the action of sprockets 77 and 78 which are mounted at the upper ends of frame 58 and the fixed location at the ends of chains 79 and 80 upon frame 16. One end of frame 72 is suspended from chain 79 which passes over sprocket 77 located at the top of frame 58 and over a sprocket 81 located at the bottom of frame 58 and is then connected to a bracket 82 which is attached to frame 16. Sprocket 78 is similarly arranged with chain 80 attached at one end to frame 72 and connected at the other end to a bracket 83 attached to frame 16 after passing over a sprocket 84 located on frame 58. A similar arrangement of sprockets and chains is used to raise and lower frame 73 on vertical frame 56. Of course, it would be possible to utilize a system of cables and pulleys in place of the chains and sprockets without departing from the spirit of my invention.

The chain and sprocket arrangement discussed in the preceding paragraph causes frames 72 and 73 to be lowered in coordination with the separation of vertical frames 56 and 58 by an amount equal to one-half of the change in distance between frames 56 and 58 which is introduced by piston and cylinder unit 66. This separation of frames 56 and 58 is to accommodate the increasing width of a case located between the frames as the case is opened as explained below.

Mounted on frame 72 is a set of plurality of rubber wheels 87 which is driven by motor 67. A similar set of wheels 85 driven by motor 88 is mounted in frame 73. With the exception of the wheels which are mounted immediately below motors 67 and 88, wheels in sets 85 and 87 are pivotally spring mounted for rotation about an axis parallel to the case transfer path from frames 72 and 73 so that they will exert a positive force against the face of a case inserted between frames 56 and 58. The wheels mounted below motors 67 and 88 are spaced, when frames 56 and 58 are in the initial position, so that they will grasp the leading edge of a case delivered from chute 45.

Each of the wheels in set 85 is directly coupled to motor 88 by a conventional transmission. Each of the wheels in set 87, with the exception of the wheel adjacent the output of the case opening mechanism, is coupled to motor 67 through a one-way bearing 86. Use of one-way bearings to connect these wheels to the drive train permits them to free wheel during the portions of the case opening cycle when the face of the case is moving more rapidly along the case opening path than the drive provided by wheels 87.

The case opening mechanism is positioned as shown in FIGS. 4, 5 and 6 to receive a closed case. Frames 56 and 58 are drawn together thereby positioning frames 72 and 73 in their full uppermost positions. Sets of wheels 85 and 87 are driven so that wheels in set 87 are rotated in a clockwise direction as viewed in FIG. 5 and wheels in set 85 are driven in a counter-clockwise direction.

A case which is driven from the case feeder mechanism has its leading edge inserted into the nip of the first opposing pair of wheels 85 and 87 and is drawn along the case transfer path into the case opening mechanism by the action of the wheels 85 and 87 until it trips limit switches 89 and 90 which are mounted on frames 56 and 58 respectively, and are actuated when the leading edge of the unopened case reaches actuating arms 91 and 92 which project into the case transfer path through the machine. Actuation of limit switches 89 and 90 (shown as LS-5 and LS-6 in FIG. 19) actuates the control circuit of FIG. 19 causing wheel set 85 to be stopped, thereby restraining movement of the case along the transfer path. The case is also restrained by a solenoid controlled case stop plunger 63 which is interposed in the transfer path by the control circuitry of FIG. 19. At the time that an unopened case is inserted into the case opening portion of the machine, the flap closers 110 and 111 are in the position shown in phantom outline in FIGS. 5 and 6.

Actuation of limit switch 89, through the control circuitry of FIG. 19, applies vacuum to cups 93 and 94 and causes sets of suction cups 93 and 94 to be actuated by an actuator 95 which brings them into contact with the faces of the unopened case adjacent frames 58 and 56 respectively.

Figure 8:
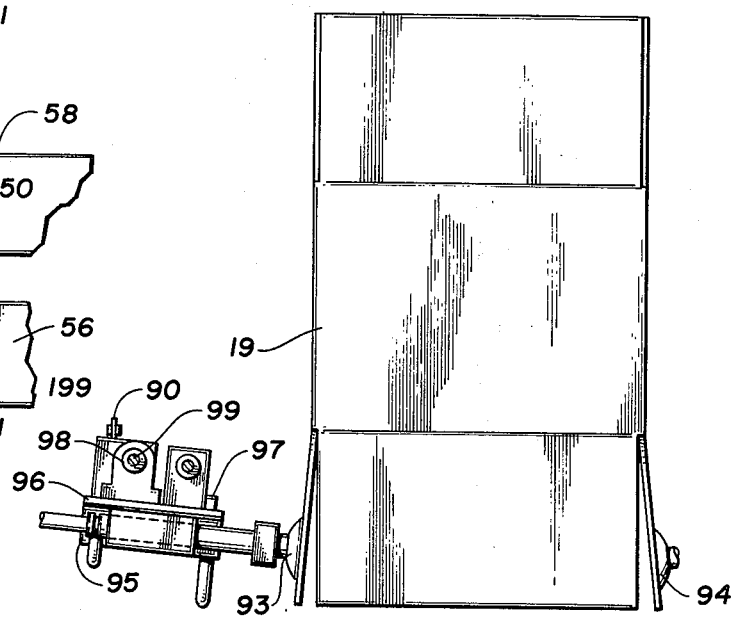
FIG. 8 illustrates the action of the vacuum cups in the case opening mechanism in bending the carton flaps slightly out from the side of the case.

As shown in detail in FIG. 8, suction cups 93 and 94 are oriented to engage the face of the major case flaps rather than the minor flaps or wall of the case and also to bend the flap at a small angle outwardly from the vertical side of the case. It has been found that this orientation of the suction cups and their actuators will facilitate the opening of cases on the machine since the partial spreading of the flaps during opening of the case stiffens the case and permits it to be opened more readily by the action of wheel sets 85 and 87. The arrangement also moves the major flaps to a position where they will not interfere with the closing of the minor flaps when the case is fully opened. Suction cups 93 and 94 can alternatively be positioned to directly engage the side walls of the case rather than the flaps, although less desirable operation is achieved. Cups such as 94 are moved into engagement with the case flaps by activation of actuators 95 which are controlled by the control circuitry in FIG. 19. The vacuum used to produce suction in cups 93 is also controlled by the control circuitry in FIG. 19.

Suction cups 94 and their related actuation mechanism are mounted on frame 73 so that they are moved vertically with that frame. Suction cups 94 are not movable along the case transfer path as the case is opened by the case opening mechanism, although their actuator 95 and vacuum is controlled in the same manner as cups 93.

Suction cups 93 are mounted on frame 72 for vertical movement with that frame as the case is opened. Cups 93 are also mounted on carriage 96 for slidable movement along a path through the case opening mechanism. Carriage 96 is supported by sliding bearings 97 and 98 which are in turn slidably mounted on shafts 99 carried by frame 72.

Carriage 96 is moved along the case transfer path as the case is opened so that suction cups 93 are continuously in contact with the major flap of the case as it and the side of the case are moved away from the other side of the case which remains stationary while held in place by the stationary wheels of wheel set 85 and suction cups 94 as the case is opened by suction cups 93 and the rotating wheels of wheel set 87.

Movement of carriage 96 along the case transfer path is accomplished by pin 90 which projects vertically from carriage 96 through an aperture of chain 199 which is driven in coordination with the separation of frames 56 and 58 to keep suction cups 93 in continuous contact with the major case flap as that side of the case is moved away from the other side of the case and forward along the transfer path as the case is opened. Chain 199 is a continuous chain passed around sprockets 100 and 101 which are mounted at opposite ends of frame 72. Tension on chain 99 is adjusted by idler sprocket 102 which is adjustably mounted on frame 72. A further sprocket 103 is coaxially mounted with sprocket 101 engaging a further chain 104 which continuously passes over sprockets 105, 106 and idler sprocket 177. Sprockets 105 and 103 and idler sprocket 177 are mounted on frame 72 and sprocket 106 is attached to the base of frame 56. Spring 107 is connected between 56 and chain 104.

The operation of chains 199 and 104 to move carriage 96 and suction cups 93 is as follows. As a case is opened, vertical frames 56 and 58 are separated and frames 72 and 73 are lowered by chains 79 and 80. As frame 72 is lowered, a downward force is exerted by sprocket 103 on the portion of chain 104 which it engages since rotation of sprocket 103 is restrained by the drag of sprocket 101, chain 199 and carriage 96. This downward force causes an initial movement of chain 104 with a consequential counter-clockwise rotation of sprocket 105 and an extension of spring 107 until the force caused by extension of spring 107 exceeds the drag on sprocket 103 and the rate of movement of chain 104 is slowed. Sprocket 103 then begins to rotate as it moves along chain 104 and this causes sprocket 101 to rotate and move chain 199 and carriage 96. Movement of carriage 96 along frame 72 is therefore delayed as frames 56 and 58 are initially separated and is accelerated after spring 107 is displaced by an amount sufficient to generate a force corresponding to the drag on sprocket 103. This non-linear relationship between the translation of carriage 96 along the case transfer path and the separation of the vertical frames 56 and 58 is necessary to maintain suction cups 93 in non-sliding contact with the case major flaps as the case is erected.

Also shown in FIGS. 5, 6, 9 and 10 are the mechanisms used to close the front and rear minor flaps of a case which has been opened by the case opening mechanism.

Rear flap folder 111 is shown in FIG. 5 in the full upright position and in phantom lines in the lowered position. The operation of flap folder 111 is shown in more detail in FIG. 10. Flap folder 111 is pivotally attached to support arm 112 which is connected to a shaft 113 which is in turn mounted on base 16 for movement about an axis perpendicular to the case transfer path.

Figure 10:
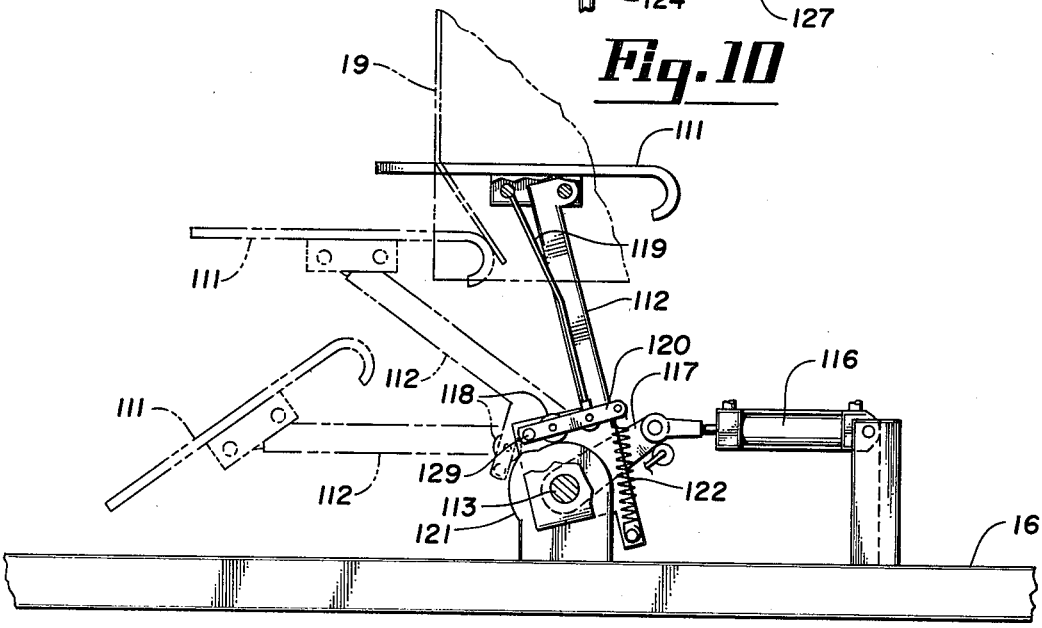
FIG. 10 is a side view showing the detail of the rear flap closing mechanism illustrating in phantom lines the orientation of the mechanism at various positions in the closing cycle.

Flap closer 111 is moved to various positions shown in FIG. 10 by piston and cylinder 116 which, when actuated, moves arm 117 to rotate shaft 113 about its axis, moving support arm 112. Variation of the angle between closer 111 and support arm 112 is accomplished by a cam follower 118 and linkage arm 119. Cam follower 118 is mounted on an arm 120 which is connected to support arm 112 at pivot point 129. Cam follower 118 is held in contact with the surface of cam 121 by spring 122. The action of cam follower 118 and cam 121 moves linkage arm 119 to vary the angle of flap closer 111 with support arm 112 as support arm 112 is raised and lowered.

The surface of cam 121 is designed such that flap folder 111 remains substantially horizontal as it is raised to close the rear minor flap of an assembled case. Since the flap folder 111 is horizontal for a large range of movement of support arm 112, it will close flaps on cases of widely varying size without the necessity of adjustment when different case sizes are fed into the machine.

Figure 9:
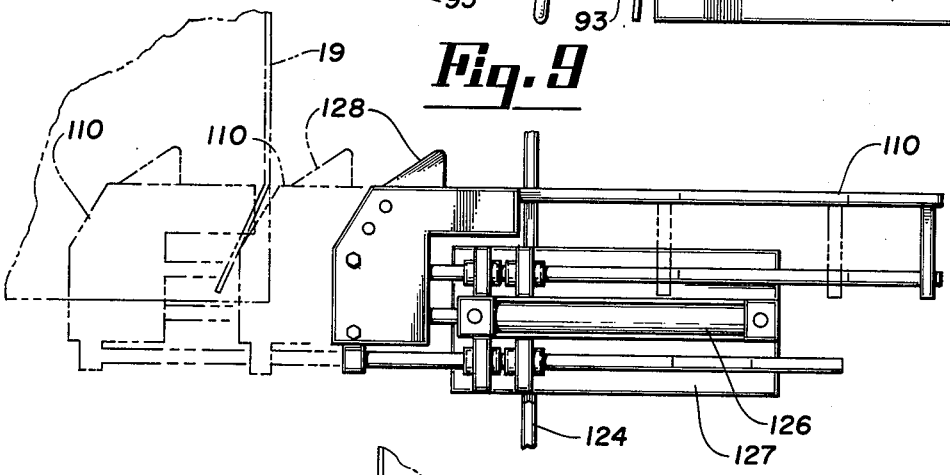
FIG. 9 is a side view showing the detail of the front flap closing mechanism showing in phantom outline form the operation of that mechanism in closing the front flaps of an opened case.

The operation of front flap folder 110 is shown in FIG. 5 in position for closing the front case flap and in phantom outline in the position it assumes when a case is fed into the case opening mechanism. FIG. 9 shows the front flap closer 110 in more detail. The front flap folder mechanism is mounted to an end plate 125 which is affixed to base 16 of the machine. An actuator 126 is attached to a flap folder frame 127 mounted on end plate 125. When actuator 126 is extended, flap closer 110 moves to the left, into the case opening portion of the machine and bends the leading minor flap upward and inward. A spring loaded dog 128 retracts into flap closer 110 after the flap has been closed.

After a case has been fully opened and the flaps closed by flap folders 110 and 111, the flap folders provide a guide for the assembled case as the rotation of wheel sets 85 and 87 drive it from the machine.

Figure 11:
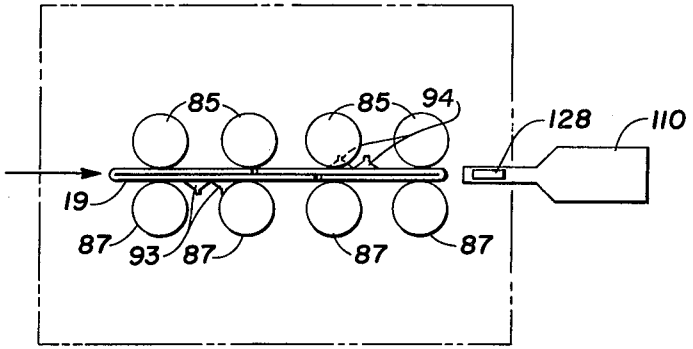
FIG. 11 is a simplified top view and FIG. 12 is a simplified side view of the case opening and bottom flap closing mechanism with an unopened case in position to be opened.
Figure 12:
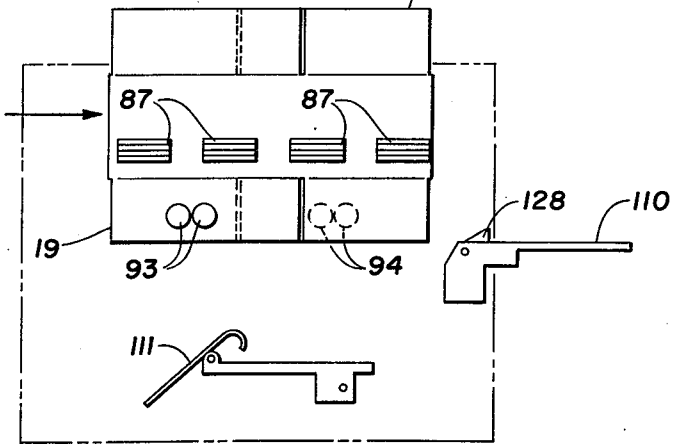

FIGS. 11 through 18 show in simplified form the sequence of operations performed by the case opening mechanism. FIGS. 11 and 12 show in top and side views an unopened case in the position it occupies when it is delivered to the case opening mechanism from the case feeding mechanism. With reference to FIG. 12, the height of the lower edge of the unopened case above the base plate is independent of the size of the case. Suction cups 93 and 94 engage the major flaps of the case and the rotation of wheel set 85 is halted.

Figure 13:
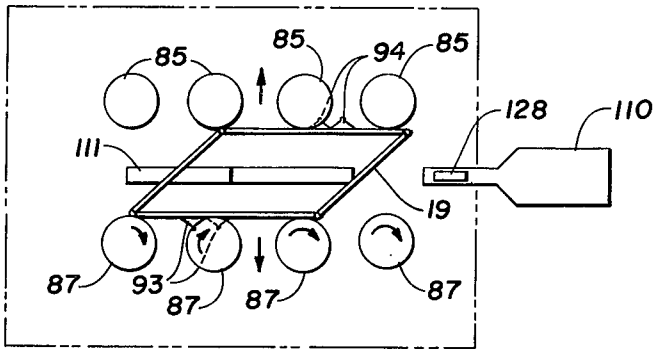
FIG. 13 is a simplified top view and FIG. 14 is a simplified side view of the case opening and bottom flap closing mechanism with a partially opened case shown in position.
Figure 14:
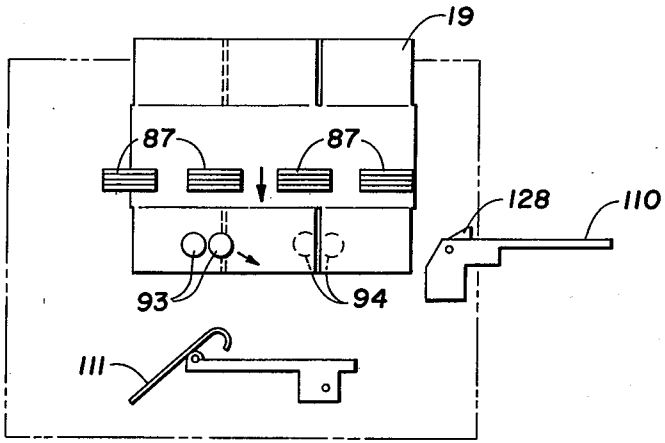

FIGS. 13 and 14 are top and side views showing a partially opened case. The action of suction cups 93 and wheel set 87 has forced one side of the case forward while suction cups 94, wheel set 85 and stop 63 hold the other side of the case stationary. Frames 56 and 58 have begun to separate to accomodate the increasing width of the case and suction cups 93 have moved along the case transfer path to maintain contact with the major flap of the case. As the case is opened, its face may be moving along the transfer path at a speed in excess of the drive wheels 87 and their one-way bearings 86 permit them to free wheel during this brief portion of the operating cycle. FIG. 14 illustrates that wheel set 87 carried by frame 72 has started to lower the case as it is opened.

Figure 15:
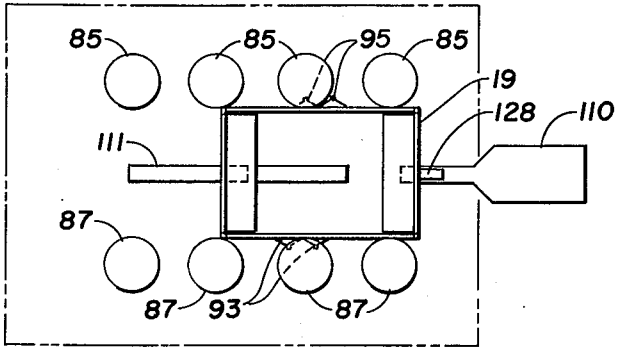
FIG. 15 is a simplified top view and FIG. 16 is a simplified side view of the case opening and bottom flap closing mechanism with a fully opened case in position and showing the front and rear flap closing mechanism partially actuated to fold the minor flaps.
Figure 16:
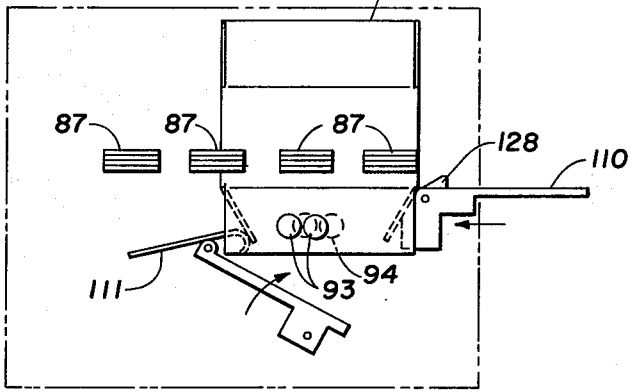
Figure 19A:
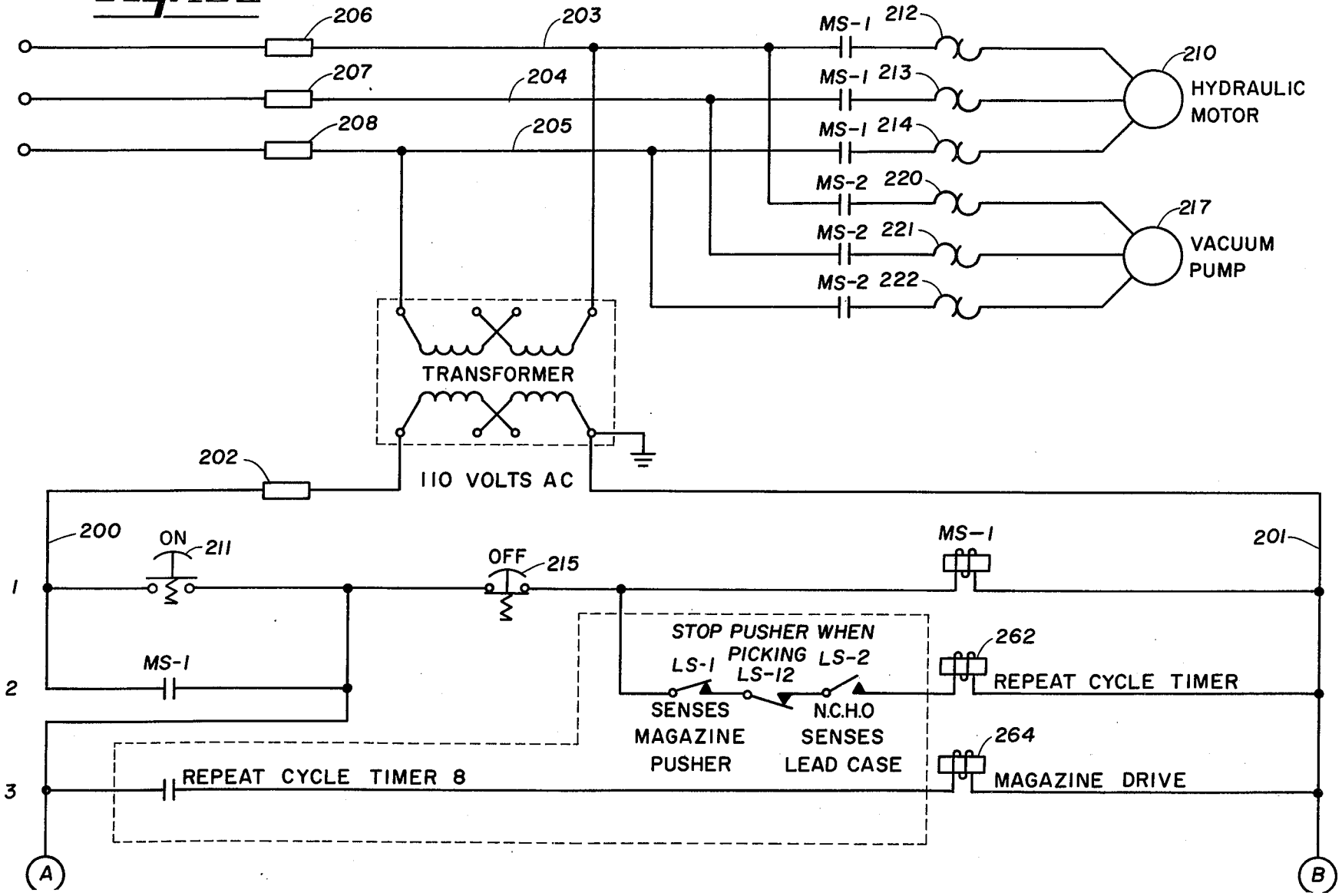
Figure 19B:
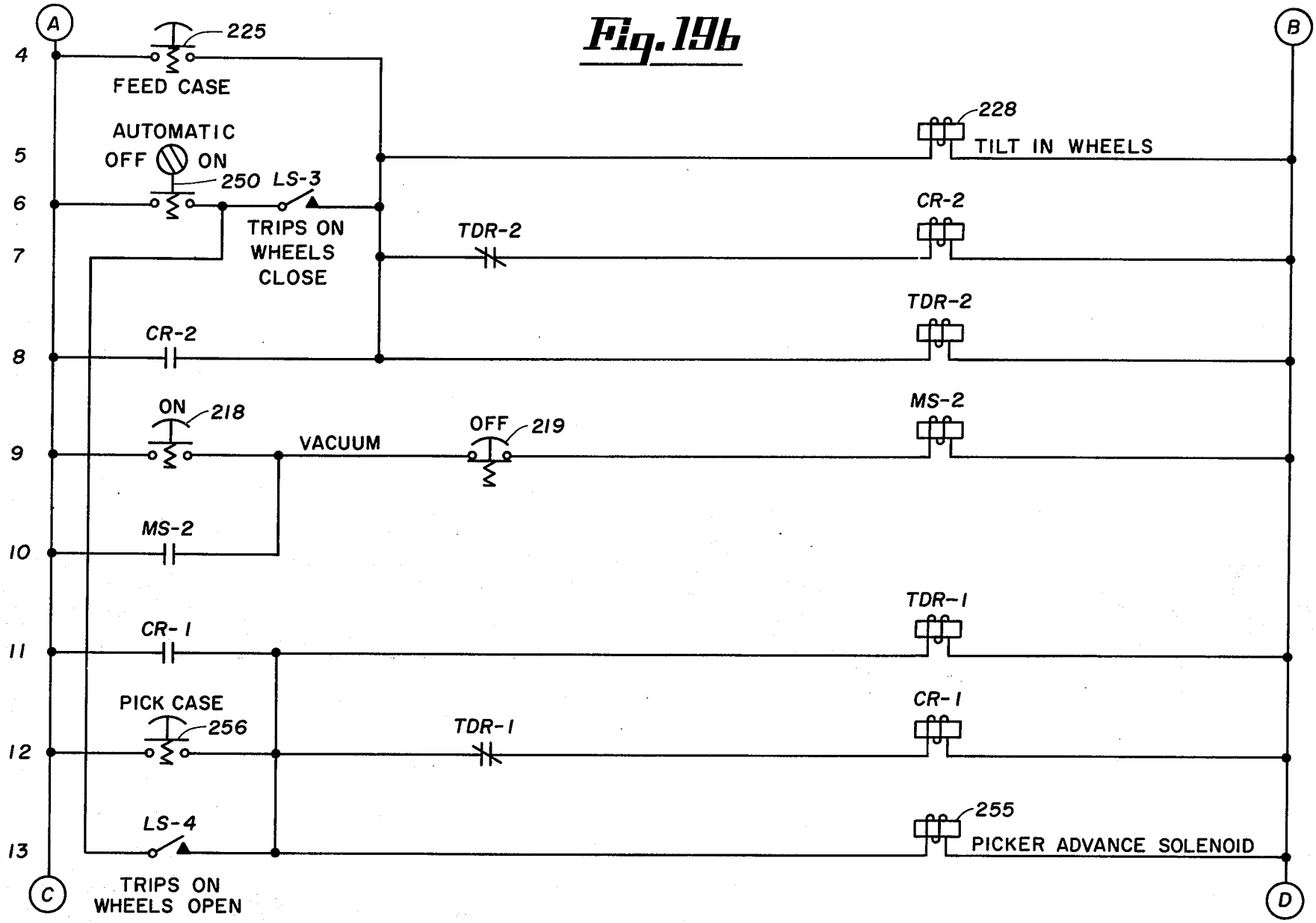
Figure 14C:
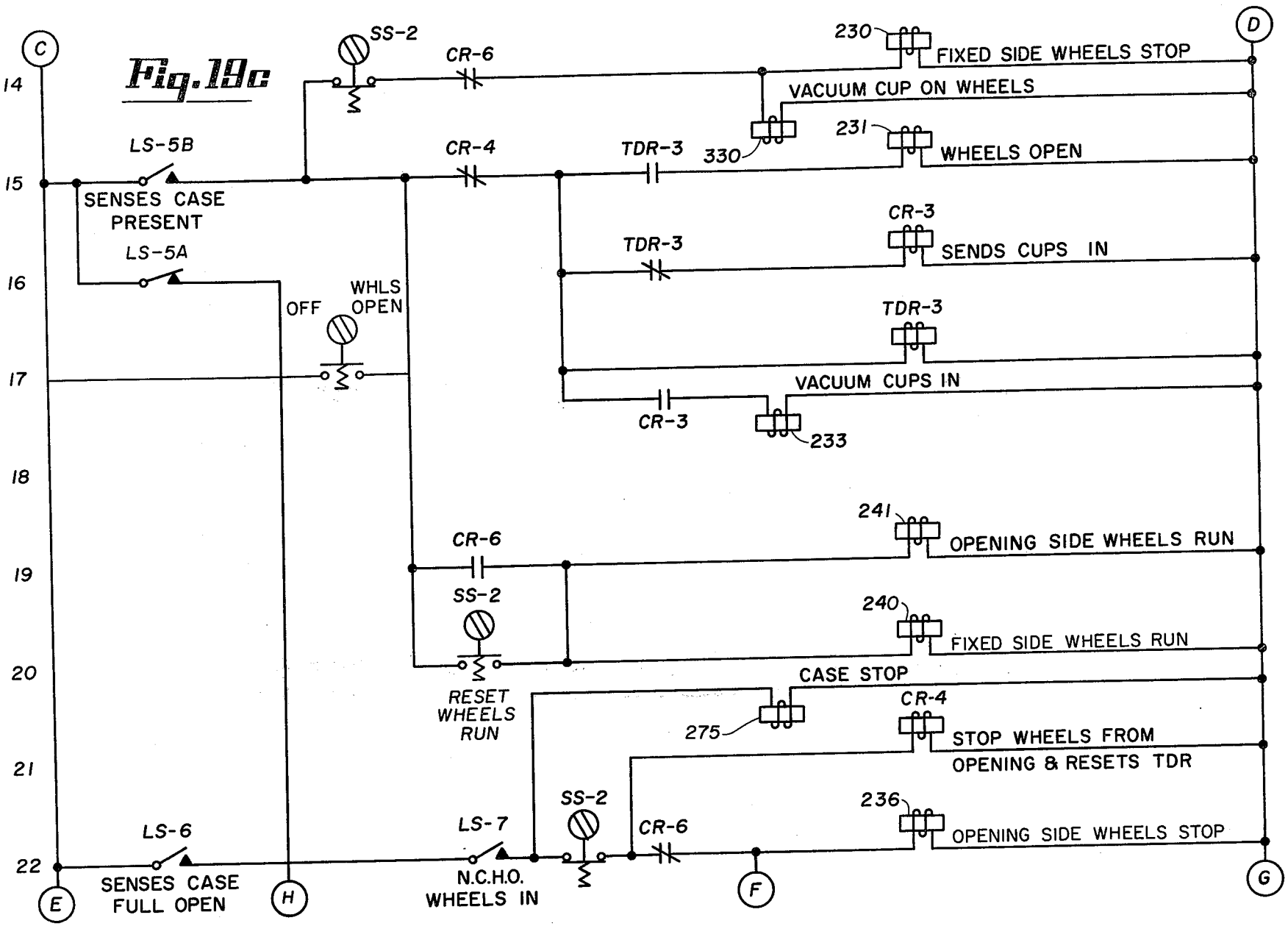
Figure 19D:
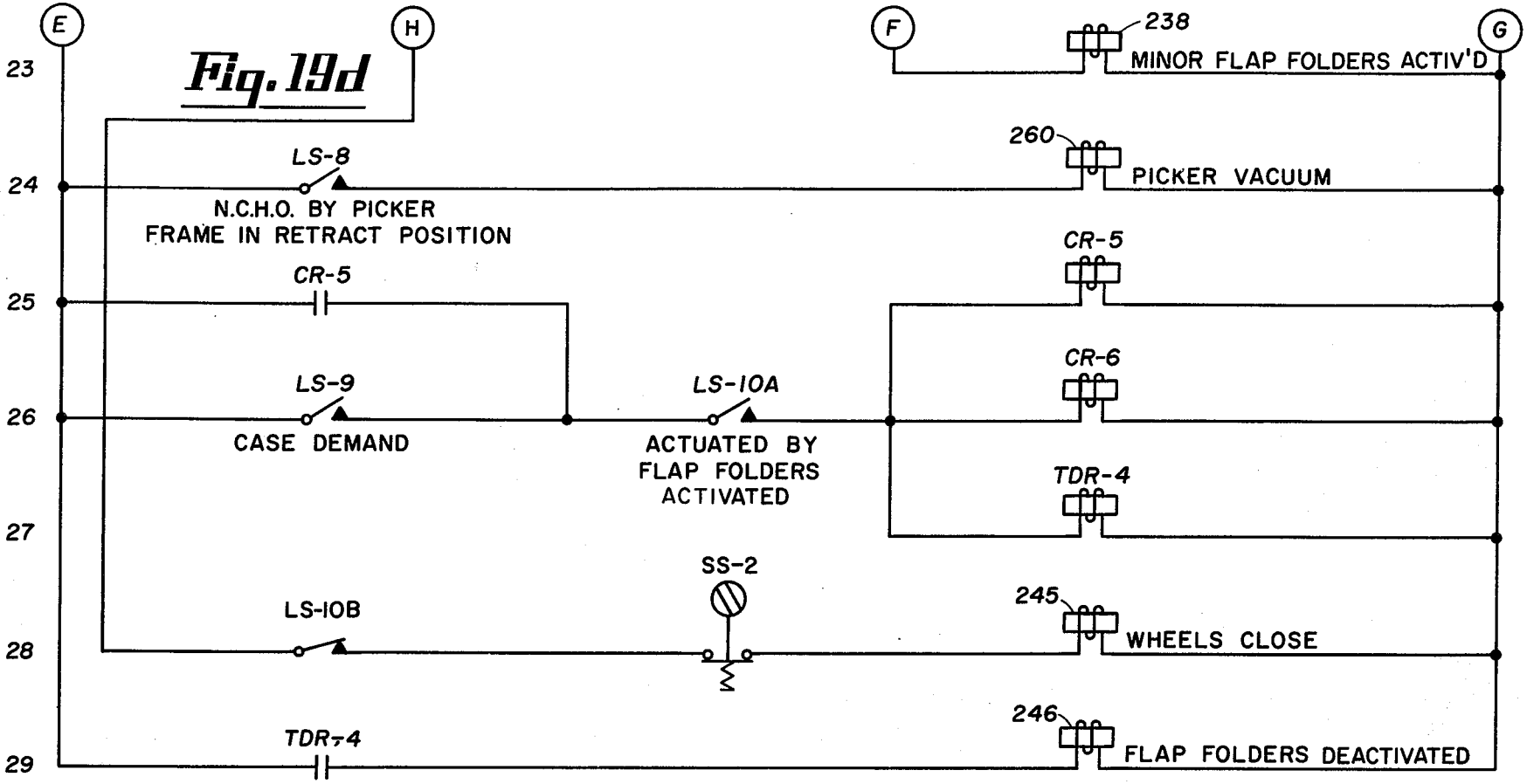

FIGS. 15 and 16 illustrate the case in its fully opened position. Wheel sets 85 and 87 are no longer rotating and the case is held in place by the spring biased wheels. The wheels of set 87 which are not connected to motor 67 by one-way bearings restrains any tendency of the case to move along the transfer path as the flap folders are actuated. The discharge base line of a case opened by the case opening mechanism is independent of the size of the case. This is accomplished by the lowering of frames 72 and 73 by a distance of one-half of the fully opened width of the case to compensate for the width of the major flaps of a regular slotted case. Flap closers 110 and 111 are shown partially actuated and have partially closed the front and rear minor case flaps. Since the machine always delivers cases of any size at a fixed height after opening the case, no adjustment to the flap closers is necessary to compensate for variations in case size.

Figure 17:
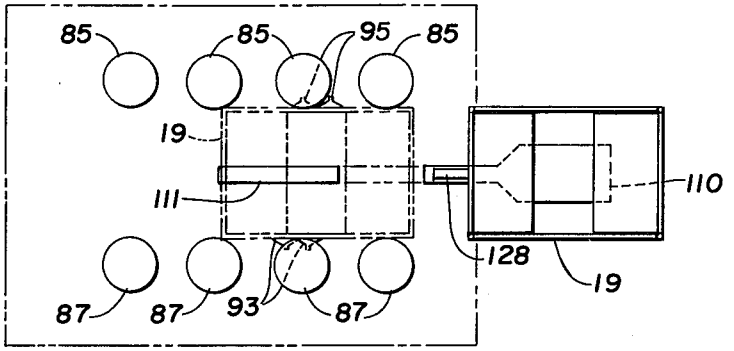
FIG. 17 is a simplified top view and FIG. 18 is a simplified side view of the case opening mechanism showing the case in the position as it leaves the machine and showing in phantom outline the completed case in the position it assumes with the front and rear flaps fully folded.
Figure 18:
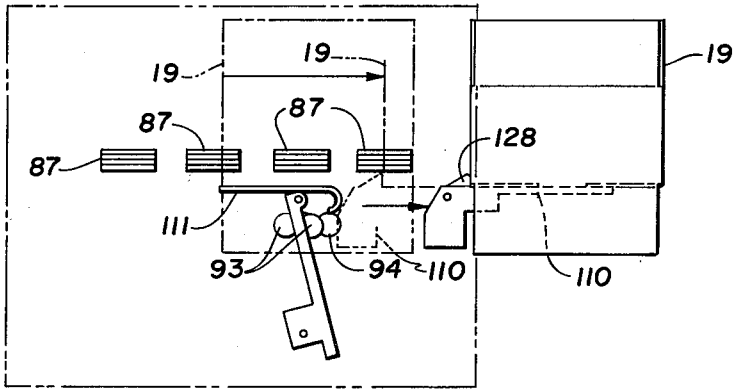

FIGS. 17 and 18 illustrate the case as it is about to be finally ejected from the case opening mechanism and in phantom outline illustrates the case as it appears with fully closed flaps before actuation of wheel sets 85 and 87 to move the case to its final location within the case opening mechanism. The upper surface of flap closers 110 and 111 provide a support surface as wheel sets 85 and 87 move the case to its final position. After the case reaches its final position, it frees dog 128, which was forced into the body of flap closer 110 by the resistance of the minor flap. Flap folder 110 is then moved to the right and dog 128 which is no longer forced into flap folder 110 is returned to its projecting configuration behind the erected case against the rear face so that it forces the case from the case opening mechanism while flap folder 110 holds the minor flaps in the closed position. The opened case may then be transported to a further location for manual or automatic loading, flap closing and sealing operations using conventional machinery. After the case is removed, the operative elements are moved to the positions shown in FIGS. 11 and 12 to receive another case.

OPERATION OF CONTROL CIRCUIT

The control circuit as shown in FIG. 19 is a line diagram showing the relationship of the various electrical controls. FIG. 20 is a hydraulic shematic which shows the various hydraulic controls operated by solenoids shown in FIG. 19. To better understand the circuit of FIG. 19, the lines appearing between a pair of power lines 200 and 201 are labeled at the left. Line numbers designating the particular electrical circuits will be used to identify the components therein.

Alternating current of 110 volts 60 cycles is applied to lines 200 and 201 through a fuse 202 which is connected in series with the secondary winding of a power transformer which has its primary winding connected to power lines 203 and 205 of a three-phase set of power lines 203, 204 and 205, which are connected through fuses 206, 207 and 208 respectively, to a source of three-phase AC power.

Hydraulic motor 210 is energized by closing switch 211 in line 1 to actuate a power solenoid MS-1 which in turn closes three pairs of normally open contacts connected to power lines 203, 204 and 205 to apply three-phase electrical power to hydraulic motor 210 through overloads 212, 213 and 214. A fourth set of normally open contacts of MS-1 located in line 2 also closes so that removal of pressure from switch 211 which is spring biased to a normally open position, will result in continued application of power to power solenoid MS-1 until switch 215, which is normally biased to a closed position is actuated to momentarily interrupt the power to MS-1 to open the contacts to hydraulic motor 210 and the latching or sustaining MS-1 contacts located in line 2. Removal of pressure from switch 215 results in its being returned to its normally closed position so that the circuit can once again be actuated by closure of switch 211.

Vacuum pump 217 which provides vacuum for suction heads 32 and suction cups 93 and 94 is energized by closing switch 218, a spring biased normally open switch located in line 9 which applies power through a spring biased normally closed switch 219 to MS-2 which is actuated to close normally open contacts connected to power lines 203, 204 and 205 to apply three-phase AC power to vacuum pump 217 through overloads 220, 221 and 222. Actuation of normally open contacts MS-2 in line 10 causes vacuum pump 217 to remain "on" after the initiating pressure is removed from switch 218 until actuation of switch 219 occurs to interrupt power to MS-2.

The cylce of operation of the machine will be described with the initial condition of the vertical frames 56, 58 assumed to be in the closed position shown in FIGS. 11 and 12 and a knocked-down case present in the chute below the picker which removes the case from the magazine. In order to transport the case from the chute 45 to the area between the vertical frames 56, 58, it is necessary to move drive wheels 48 into contact with the case in the chute and actuate the wheels. This may be done by an operator closing FEED CASE switch 225, a spring biased normally open switch located at line 4. Closure of this switch actuates solenoids 228. Solenoid 228 drives wheels 48 to tilt inwardly and engage the case in the chute 45 and propel it through chute 45 and into the area between vertical frames 56 and 58. Actuation of the FEED CASE switch 225 alo actuates control relay CR-2 through normally closed contacts TDR-2 located at line 7. Actuation of CR-2 closed normally open contacts CR-2 located at line 8 to provide a latching action and insure continued application of voltage to solenoid 228 after pressure is removed from the FEED CASE switch 225. Actuation of FEED CASE switch 225 also energizes time delay relay TDR-2 which, after a time delay, is actuated to open normally closed contacts TDR-2 in line 7 and de-energize CR-2, opening contacts CR-2 in line 8 and de-energizing solenoid 228 to allow wheels 48 to tilt out of the chute opening in order to avoid interference with the next case deposited in the chute 45 by the picker mechanism.

After the case is transported out of the chute by action of the rotation of wheels 48 projecting through the chute openings against the side of the case, it is carried through the area between the vertical frames 56, 58 until coming to rest against the stop 63 and closing limit switches LS-5 in line 15, and shown in FIG. 6 as switch 89 and LS-6. Closure of LS-5 takes the system out of the case transporting mode and commences the opening or erection of the case. Closure of LS-5 actuates solenoids 230 and 330 through the normally closed contacts of CR-6 in line 14. Acutation of solenoid 230 causes the fixed side wheels 85 to stop rotation. Actuation of solenoid 330 causes the actuation of the vacuum supply to suction cups 93 and 95. Actuation of LS-5 also actuates, through the normally closed contacts of CR-4 in line 15, three additional control elements 231, CR-3 and TDR-3. The actuation of solenoid 231 through normally closed contacts TDR-3 actuates the mechanism for separating the upright frames to accommodate the case as it is opened. Actuation of CR-3 through the normally closed contacts TDR-3 causes the closure of normally opened contacts CR-3 to actuate solenoid 233 below line 17, to force suction cups 93 and 94 against the major flaps of the case to assist in the case opening by holding the case against the rotating wheels 85 and 87 as the vertical frames 56 and 58 separate and the driven rotation of wheels 85 and cups 93 urges the erection of the case. After a predetermined time, time delay relay TDR-3 which was energized by closure of LS-5 through normally closed contacts CR-4, actuates to open contacts TDR-3 in lines 15 and 16 and remove the power from CR-3 to de-energize solenoid 233 and thereby retract vacuum cups 93 and 94 which assist in the erection of the case and to remove power from solenoid 231 which causes the wheels to start to open.

When the case is fully opened, switch LS-6 in line 22 is closed for a second time. LS-6 is connected in series through LS-7 to four additional control elements CR-4 and through the normally closed contacts of CR-6 to solenoids 236 and 238 and to case stop solenoid 275. LS-7 is a normally closed limit switch positioned as shown in FIG. 7 which is opened only when frames 56 and 58 are in the initial or starting position and drawn close together. The use of LS-7 is made necessary by the fact that LS-6 is actuated twice during a normal cycle. The first actuation of LS-6 occurs when the unopened case flap closer actuates LS-5 and LS-6. At this point, the wheels 85 and 87 are still in the closed position and LS-7 is in the open position, preventing energization of the four control elements operated by LS-6.

Upon full opening of the case and separation of the frames 56 and 58, LS-6 is again closed by the edge of the opened case and LS-7 is in its normally closed position, thus actuating control relay CR-4 which stops the mechanism causing the vertical frames 56 and 58 to open and, also, breaks the circuit to TDR-3 and resets time delay relay TDR-3. Closure of LS-6 when the case is fully opened also actuates, through the normally closed contacts of CR-6 in line 22, solenoid 236 to de-energize and stop the set of wheels 87 which were driven to cause the opening of the case. Finally, the actuation of LS-6 when the case is fully opened actuates solenoid 238 in line 23 to actuate the minor flap folders to close the minor flaps of the case and actuates solenoid 275 to retract case stop solenoid 275.

After the minor flap folders 110,111 have been fully operated to close both minor flaps, limit switch LS-10 in line 26 is actuated. When the case demand limit switch LS-9 is closed at a work station external to the case former, the closure of normally open contacts LS-10A energizes the four control devices at lines 25 through 27. The first device on line 25 is control relay CR-5 which closes normally open contacts CR-5 in line 25 to provide a latching action to continue to energize switch LS-10 after case demand switch LS-9 opens as the box leaves the case opening apparatus. Actuation of LS-10 also energizes control relay CR-6 in line 14 to open to remove energization from solenoid 230, the solenoid which terminates the driving of the fixed side wheels 85 and removes the vacuum cups 93 and 95 by de-energizing solenoid 330. Actuation of CR-6 also closes normally open CR-6 contacts at line 19 to energize solenoids 240 and 241. Solenoid 240 causes the fixed side wheels 85 to begin to run, while solenoid 241 causes the opening side wheels 87 to commence running again. A third control element actuated by the closure of contacts LS-10A is time delay relay TDR-4 in line 27 which, after it has been energized for a predetermined period, causes normally open contacts TDR-4 in line 28 to close to energize solenoid 246 to deactivate both flap folders. Actuation of LS-10 also causes normally closed contacts LS-10B to open and opens the circuit to solenoid 245 to enable the mechanism controlling the upright frames 56 and 58 to commence the closure of the upright frames to the initial closed position to receive the next collapsed carton. As the flap folders retract, LS-10A opens and de-energizes solenoids CR-5, CR-6 and TDR-4 to return that portion of the circuit to its initial condition.

When the upright frames 56 and 58 have been returned to the closed position, they trip limit switch LS-3 in line 6 which sends, when the automatic mode select switch 250 is in the closed position, a "feed case" command to solenoids 227,228, control relay CR-2 and time delay relay TDR-2. The command from LS-3 is equivalent to the "feed case" command given initially by the feed case switch 225 which was used to commence operation. Thus, the entire sequence of operation is again repeated provided another case has been deposited in chute 45 below the picker from the magazine during the erection of the previous case.

The replacement of the knock-down case in chute 45 automatically is accomplished by having the case picker remove the forward case in the magazine, position it over the chute and drop it into the chute. This is accomplished by the circuitry shown at lines 11 through 13. At the time that a case is being opened and vertical upright frames 56 and 58 are separated by actuation of solenoid 231, LS-4 in line 13 is closed to actuate three control devices, TDR-1, CR-1 and solenoid 255. The closing of limit switch 4 actuates the picker advance solenoid 255 in line 13 to cause the vacuum suction head 32 to be advanced to bring the cup 32 into contact with the face of the forward carton in the magazine.

Actuation of LS-4 also actuates control relay CR-1 through normally closed contacts TDR-1. Actuation of control relay CR-1 closes normally opened latching contacts CR-1 in line 11 when the manual PICK CASE DEMAND switch 256 is used to initiate operation of the case picking solenoid, rather than the automatic functioning initiated by closure of limit switch LS-4.

The functioning of control relay CR-1 causes the picker advance solenoid circuit to function correctly even if the actuation of manual pick case switch 256 is of very short time duration. Time delay relay TDR-1, which is energized by closure of switch 256 or limit switch LS-4, actuates its contacts after a predetermined time interval which is selected to be sufficient to allow the vacuum picker to advance and come into contact with the lead case in the magazine. After this time has elapsed, the contacts are actuated and normally closed contacts TDR-1 in line 12 are opened to interrupt the current to control relay CR-1 and open holding contacts CR-1 in line 11 to de-energize picker advance solenoid 255. As this solenoid is de-energized, a spring causes the picker to retract and pull the case over the open chute. When the picker reaches its retracted position, limit switch LS-8 in line 24 is actuated and is switched into its open position to de-energize picker solenoid 260 and shut off the picker vacuum. When the vacuum is removed, the case drops into chute 45 and is ready to be delivered to the case opening mechanism upon the next actuation of the FEED CASE switch 225 or the next automatic operation sequence initiated by closure of the frames 56 and 58 to the starting position and the consequent actuation of limit switch LS-3.

The lead case is replaced in a forward position on the case magazine by the operation of the circuitry shown at lines 2 and 3. Limit switch LS-1 which senses the presence of the magazine pusher and limit switch LS-2, a normally closed limit switch held open by the presence of the lead case, are connected in series through a normally closed limit switch LS-12 and through the power circuitry in line 1 to the AC line and to the repeat cycle timer 262 in line 2. Limit switch LS-1 sensing the magazine pusher, remains in the closed position as long as there are cases loaded in the magazine. Limit switch LS-2 is in the closed position at times when the lead case has been removed from the magazine. Thus, after the lead case has been removed from the magazine by operation of the vacuum picker, both switches are in the closed position and actuate the repeat cycle timer 262. Actuation of the repeat cycle timer during the picking operation is prevented by the normally closed contacts of LS-12 which are opened when the picker is extended. Actuation of the repeat cycle timer 262 closes the normally opened contacts in line 3 to actuate the magazine drive solenoid 264 and step the chain drive for the magazine one step which very nearly corresponds to the thickness of a single carton. Thus, the magazine drive continually functions to replace the lead case as it is removed. The case picker functions to remove the lead case each time the PICK CASE switch 256 is initiated or the limit switch LS-4 has been closed to indicate the opening of a carton. The fact that the next case can be extracted from the magazine during the erection of the first case contributes to a rapid operation of the overall mechanism.

In addition to the portions of the control circuitry of FIG. 19 which are discussed above, a reset switch 276, having normally closed contacts in lines 14, 22 and 28 and normally open contacts in lines 17 and 20, is also included to reset the machine if its operation were interrupted as the case were being opened.

FIG. 20 shows the relationship of the various hydraulic control elements shown in FIGS. 2 through 18 and their relationship with the electromechanical elements shown in FIG. 19.

Where piston and cylinder actuators have been shown, it is clear that conventional actuators of either the hydraulic or pneumatic variety may be selected with comparable results.

Although the above description was made with reference to regular slotted cases having a major flap width equal to one-half of the width of the case, it is apparent that it can also be used with other cases with different flap configurations with minor modifications. For example, center special slotted cases having major flaps with a length less than one-half the width of the opened case can be run. To assure that the cases are delivered from the case opener along a fixed discharge base line, a spacer may be placed in chute 45 to adjust the height at which the case is inserted in the case opening mechanism.

It will be apparent to those skilled in the art that various changes may be made in the details of construction of the apparatus without departing from the inventive concept. The scope of the invention is, therefore, not limited to that which is shown in the drawings and described in the specification, but only as indicated in the appended claims.

I claim:

1. Apparatus for opening rectangular knockeddown cases comprising:

a pair of opposed movably mounted frames;

frame moving means for controllably moving said frames toward and away from each other to form a case opening area between said frames;

rotary means carried by said frames for engaging opposite sides of a case as it is received between said frames and for progressing such a case between said frames in a direction transverse to the direction of relative movement of said frames;

means mounted on said frames for maintaining said rotary means in engagement with such a case while it is disposed between said frame;

means for altering the direction of rotation of at least one of said rotary means carried by one of said frames (and constructed and arranged) to open such a case between said frames as they are moved away from each other by said frame moving means;

control means connected with said frame moving means for arresting the opening movement of said frames when such a case has reached an open position and for closing the same after the case has been removed therefrom; and means for moving such a case away from said case opening area after the case has been so opened.

2. Apparatus of the class described in claim 1 wherein:

said rotary means are mounted on further movably mounted frames which are vertically movable on said pair of opposed movably mounted frames; and further means to lower said further frames from an initial vertical position in which an unopened case is received to a final vertical position which is predetermined and fixed independent of the size of the case(.); and said means mounted on said frames for maintaining said rotary means in engagement with such a case comprises suction means.

3. Apparatus of the class described in claim 2 which also includes end flap closing apparatus comprising:

a plow bar aligned with the leading end flap of an opened case in the case opening area and positioned at a fixed height to engage said end flap and bend it upwardly and inwardly when actuated.

4. Apparatus for opening rectangular cases each having a pair of end panels and a pair of larger side panels, one of which trails the other, the cases being received in a knock-down configuation, said machine comprising:

a base;

a first and a second frame, said frames being movably mounted on said base for movement with (the) respect to said base and each other;

a first and a second plurality of wheels carried by said base and mounted on third and fourth frames for rotation about a plurality of axes dispersed along the length of said first and said second frames, said third frame being mounted on said first frame and said fourth frame being mounted on said second frame, the radius and location of the axes of said wheels being arranged such that tangent lines to said wheels between said first and second frames and parallel to the general vertical plane of said first and second frames define a pair of substantially parallel vertical planes;

a first and a second suction device mounted on said first and said second frames respectively, said suction devices positioned to engage the side panels of the case when it is located in the case opening area, said suction devices including suction control means for actuating said first and said second suction devices to exert a force on the case urging the case into contact with said wheels;

actuator means for moving said first and said second frames when activated to vary the distance therebetween from an initial position where the distance between the two vertical planes of the wheels is approximately equal to the thickness of an unopened case to a final position where the wheels upon the third and fourth frames are separated by a distance corresponding to the width of the fully opened case;

case delivery means for inserting the leading vertical edge of a vertically oriented folded case between said first and said second frames while they are in the initial position to cause the case to become positively engaged by said first and said second plurality of wheels;

first controlled means for driving said first and said second plurality of wheels to transport said case into a case opening area between said first and said second vertical frames;

control means actuated when said case is located in said case opening area for driving at least one wheel in one plurality of said first and said second pluralities of wheels to cause the driven wheels of said plurality of wheels to exert a force on one side panel of the case with respect to the other, tending to move the trailing panel relative to the other panel and thereby urging the case toward the open position;

said control means also activating said actuator means to increase the distance between said first and said second vertical frames to expand the case opening area to accommodate the width of the case as it is opened;

means for driving (both) at least one wheel in each of said first and said second pluralities of wheels after the case is fully opened to remove the opened case from the case opening area.

5. A case opening machine for opening rectangular cases each having a pair of end panels and a pair of side panels and each case being sequentially presented to the machine in a knocked-down configuration with one end and side panel forward and the other end and side panel rearward and flat against the foremost panel, said machine comprising:

first and second parallel frames mounted parallel on a base for movement toward and away from each other and to the base to alter the width of the case opening area between said parallel frames;

a first plurality of wheels mounted on substantially vertical axes distributed along said first frame, each wheel of said first plurality of wheels projecting equally into said case opening area;

a second plurality of wheels mounted on substantially vertical axes distributed along said second frame, each wheel of said second plurality of wheels projecting equally into said case opening area;

suction means attached to said first and said second frames for grasping the side flaps of the case when activated;

actuator means for moving said first and said second frames on said base to a case receiving position where the initial separation of said first and said second pluralities of wheels from each other corresponds to the thickness of an unopened case;

case feeder means for delivering a plurality of knocked-down cases of varying size to a case delivery position, said case feeder means being loaded with a plurality of cases vertically oriented with their bottom flaps lowermost, said case feeder means also including means for continually positioning a lead case in a predetermined position;

case picker means for removing the lead case from the delivery position of said case feeder means and introducing it into a case transfer means;

case transfer means for receiving a knocked-down case from said case picker means and positioning at least the leading edge of said knocked-down case between said first and said second plurality of wheels;

means for rotating at least one wheel of each of said first and said second pluralities of wheels to move said case from said case transfer means into said case opening area between said first and said second frames;

means for actuating said suction means and for rotating at least one wheel of only the plurality of wheels located on the side of the case having its end panel adjacent the leading edge of said case whereby that side of the case is forced forward and away from the other side of the case by continued rotation of that plurality of wheels to open the case;

means for separating said first and said second frames to accommodate the opened case so that the case may be opened to its full rectangular configuration;

means for sensing the completed opening of said case and for removing the actuation from said suction means and stopping rotation of the (plurality of) wheels rotated to open said case; and means for removing the opened case from the opening area.

6. Apparatus of the class described in claim 5 wherein said means for removing the case from the opening area comprises:

means for rotating said first and said second pluralities of wheels to propel the case from the case opening area.

7. Apparatus of the class described in claim 5 wherein additional means are provided for delivering the opened case at a predetermined height irrespective of the sides of the case, said additional means comprising:

means for lowering said first and said second plurality of wheels relative to the base of the machine in coordination with the means for separating said first and said second frames such that the case opened by the machine is lowered by a distance corresponding to one-half of the width of the end panel of the case when said first and said second frames are separated sufficiently to accommodate the width of the end panel of the opened case.

8. Apparatus of the class described in claim 7 wherein wherein additional means are provided for closing the flaps projecting from the end panels before removing the case from the case opening area.

* * * * *

UNITED STATES PATENT OFFICE

CERTIFICATE OF CORRECTION

Patent No. 3,982,474 Dated September 28, 1976

Inventor(s) Robert N. Klund

It is certified that error appears in the above-identified patent and that said Letters Patent are hereby corrected as shown below:

Column 10, line 35, "cylce" should read -- cycle --.

Column 10, line 50, "alo" should read -- also --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*